United States Patent [19]

Turner

[11] 4,078,162

[45] Mar. 7, 1978

[54] BLADE LOCK FOR ELECTRIC SWITCH

[75] Inventor: John L. Turner, East St. Louis, Ill.

[73] Assignee: Turner Electric Corporation, East St. Louis, Ill.

[21] Appl. No.: 669,221

[22] Filed: Mar. 22, 1976

[51] Int. Cl.[2] ..... H01H 31/00

[52] U.S. Cl. ..... 200/48 A; 200/48 KB; 200/273; 200/318; 200/222; 200/326

[58] Field of Search ..... 200/48 A, 48 KB, 273, 200/318, 326, 222

[56] References Cited

U.S. PATENT DOCUMENTS

| | | | |
|---|---|---|---|
| 1,737,334 | 11/1929 | Rohrer | 200/326 |
| 2,835,770 | 5/1958 | Foti | 200/322 |
| 3,144,536 | 8/1964 | Bridges et al. | 200/318 |
| 3,174,004 | 3/1965 | Stene et al. | 200/318 |
| 3,243,534 | 3/1966 | Turner | 200/48 A |
| 3,711,662 | 1/1973 | Kuhn | 200/48 A |
| 3,836,737 | 9/1974 | Redfern | 200/48 A |

*Primary Examiner*—Brooks H. Hunt

*Attorney, Agent, or Firm*—F. Travers Burgess

[57] ABSTRACT

The invention provides an improved positive latch for high voltage, air break disconnect switches of the type having an elongated blade with one end swiveling on a terminal to switch its opposite end from the remote terminal, the blade being rotatable about its longitudinal axis and relative to the terminals and provided at its switching end with a transversely projecting contact lug shiftable by rotation of the blade into and out of frictional engagement with the remote terminal. The latch is pivotally mounted on the remote terminal and has a hook-like portion spring biased downwardly into latching position with respect to the end portion of the blade and is rotatable out of latching position by engagement with the latch of an arm carried by the blade when the contact lug is rotated out of engagement with the remote terminal and is formed with an extension engageable with the blade mounted latch operating arm for opening the latch as the blade approaches closed position.

10 Claims, 8 Drawing Figures

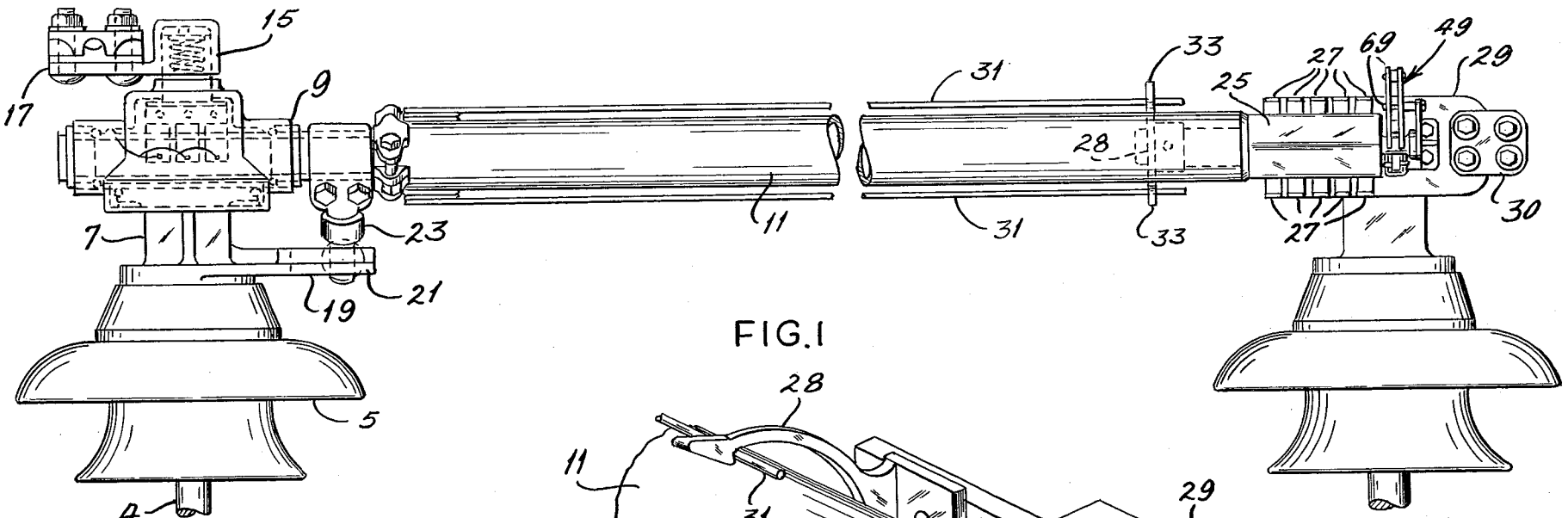
FIG.1
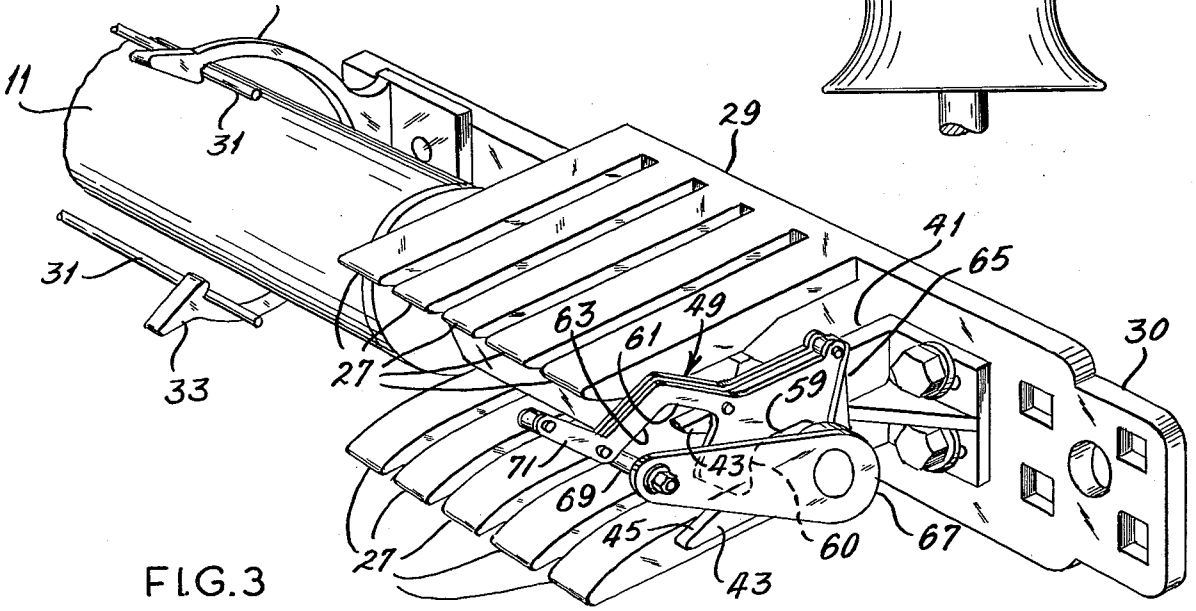
FIG.3
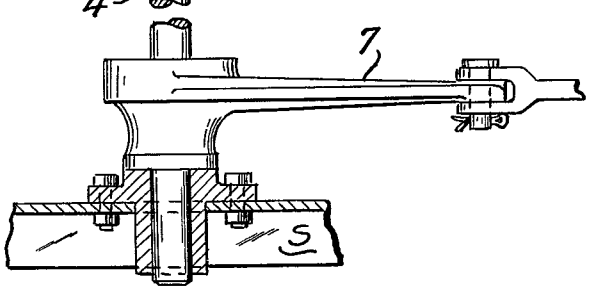

BLADE LOCK FOR ELECTRIC SWITCH

BACKGROUND OF THE INVENTION

1. Field of the Invention

The invention relates to a high voltage, air break disconnect switch and more particularly to a blade lock for a switch including an elongated blade which is rotated manually about its longitudinal axis and swung about a transverse axis when disengaging and engaging stationary jaws on a contact member.

2. The Prior Art

In previous switch units of this general type as exemplified by my U.S. Pat. No. 3,243,534, a safety lock for holding the blade in closed position consisted of a latch member mounted on the blade near the contact jaws on an axis parallel to the blade and thrust upwardly by a torsion spring. The end of the latch was formed with an upwardly open hook underlying engageable with a pin mounted on the contact block. The end of the latch was tapered downwardly so as to cause the latch to underride the terminal-mounted pin as the blade approached fully closed position and the end of the latch adjacent the blade was formed with a stop to limit upward movement of the outer end of the latch.

While this latch performs satisfactorily in most cases, if the insulator supporting the terminal is slightly tilted, the latch member might override the pin and thus not secure the blade in closed position.

SUMMARY OF THE INVENTION

The invention provides a positive lock for the blades of high voltage, air break disconnect switches of the type in which an elongated blade is manually rotated about its longitudinal axis and swung about a transverse axis for disengaging and engaging the contact lug of the blade with the contact jaws.

According to the invention, the latch is released responsive to rotation of the blade out of jaw engaging position and is moved to locking position responsive to rotation of the blade into jaw engaging position.

It is an object of the invention to provide a positive locking device operative to lock the blade in closed position whenever the blade is in full jaw engaging position, irrespective of distortion of the jaw mounting structure wherein the normally vertical plane of the jaws is disaligned from the normally vertical axis about which the blade is swung.

BRIEF DESCRIPTION OF THE DRAWINGS

FIG. 1 is a side elevation of a switch incorporating the invention.

FIG. 3 is an enlarged isometric view of the contact block and adjacent portion of the switch blade in locked position.

DETAILED DESCRIPTION OF THE INVENTION

Figure 2:
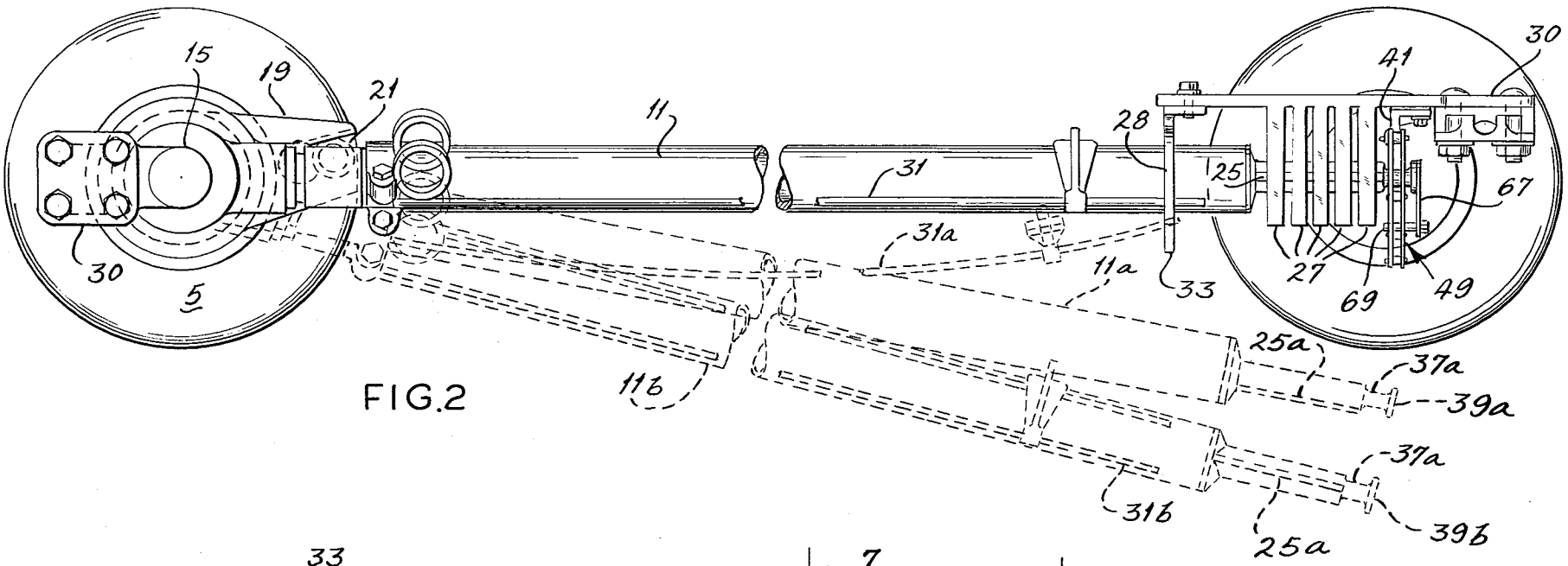
FIG. 2 is a top view of the switch illustrated in FIG. 1.
Figure 4:
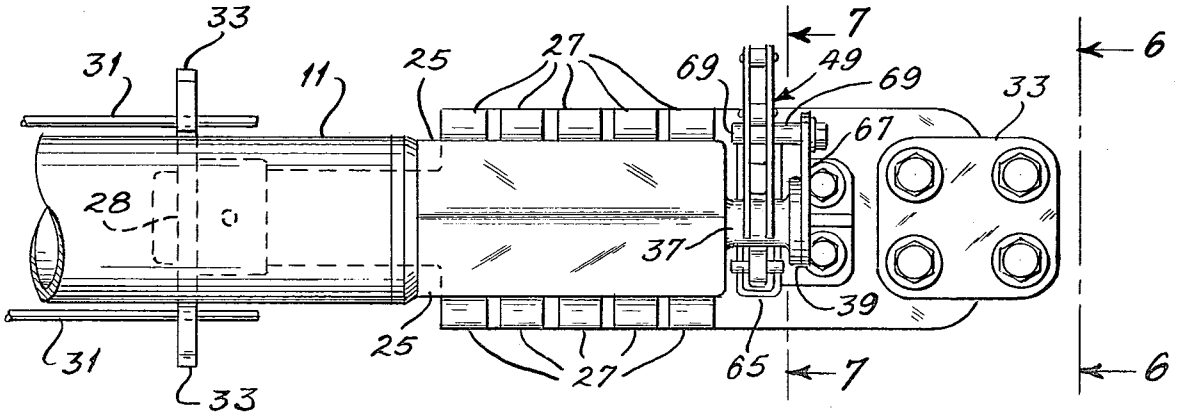
FIG. 4 is an enlarged side elevational view of the contact block, blade lock and adjacent end of the blade in closed position.
Figure 5:
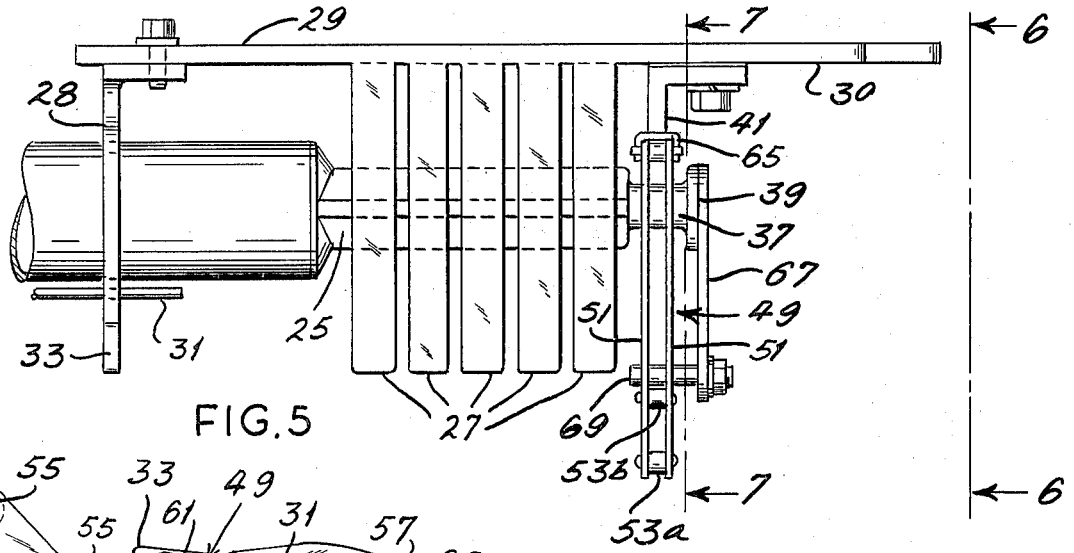
FIG. 5 is an enlarged top view of the contact block, blade lock and adjacent end of the blade in locked position.

The switch unit is mounted on an individual metal channel support S. A bearing 3 on support S journals a shaft 4 to which is fixed an insulator 5. A crank arm 6 extends radially from shaft 4 for connection to manually actuated linkage to provide for manual rotation of shaft 4. Above insulator 5 is a base 7 which turns with shaft 4. A bearing cap 9 swivels on base 14 and may turn with the shaft and also relative thereto.

An elongated tubular blade 11 is journaled at its inner end in bearing cap 9 for rotation about its longitudinal axes at right angles to shaft 4, such that blade 11 is swingable about the axis of shaft 4 by rotation of shaft 4 and is rotatable about its own axis. A shaft 13 extends upwardly from bearing cap 9 and mounts a pivot cap 15 having a conductor plate 17 forming the right hand terminal of the switch to which a line (not shown) may be clamped. For rotating blade 11 about its axis responsive to rotation of shaft 4 about its axis, base 14 is formed with an arm 19 which is pivotally connected at its outer end at 21 to a lever 23 secured to blade 11, such that initial rotation of shaft 14 about its axis will cause blade 11 to rotate $22\frac{1}{2}°$ about its axis.

The right hand or outer end of blade 11 is a lug of vertically elongated cross-section and has silver overlay cam contacts 25 normally disposed vertically to engage and spread jaws 27 on contact block 29 which has a terminal extension 30 to which a line (not shown) may be clamped. Resilient arcing horns 31 have their right hand ends clamped to blade 11 near its bearing in cap 9 and the left hand ends of horns 31 normally engage hooks 28 mounted on contact block 29.

Figure 8:
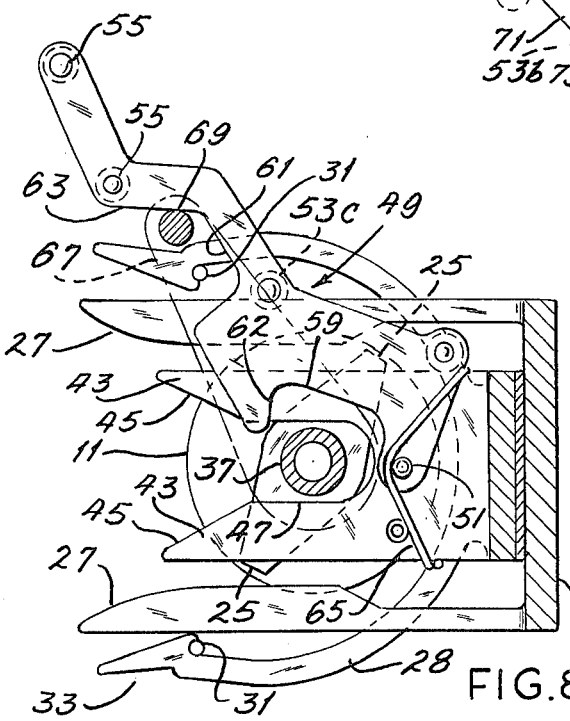
FIG. 8 is a transverse vertical sectional view taken along lines 7—7 of FIGS. 4 and 5 showing the blade lock in open position.

When base 7 is rotated in a clockwise direction (FIG. 2), the blade is rotated about $22\frac{1}{2}°$ about its longitudinal axis to the position shown in FIG. 8, contacts 25 clear jaws 27 and current is shunted wholly through resilient arcing horns 31 to contact hooks 33 and continued rotation of shaft 4 causes blade 11 to move to the position shown in broken lines at **11*b* in FIG. 2, in which the arcing horns 31 are curved as at 31*a* and the circuit is still closed. Continued rotation of shaft 4 moves the switch blade 11 to position 11*c* and the arcing horns snap pass hook terminals 33, opening the circuits, and they then immediately resume their initial parallel relation to blade 11, as seen at 31*c* in FIG. 2**.

The present structure avoids the possibility of the blade-lock not functioning when the blade is slammed to closed position in the event that, due to tilting of the insulator mounting on the contact block, the latch overrides the pin and does not perform its latching function.

The extremity of blade 17 outwardly of contact portions 25, 25 is a short reduced diameter section 37, having an annular flange 39 at its end, and contact block 29 mounts a guide jaw member 41, the vertical spaced jaws 43 of which are tapered as at 45 to guide blade section 37 into the jaw aperture 47 which is of slightly greater height than the diameter of blade section 37.

A latch member generally indicated at 49 is pivoted at 51 to jaw member 41 inwardly of the inner end of aperture 47 and substantially on the horizontal center line of this aperture. Latch 49 consists of a pair of plates 51 positioned on opposite sides of guide jaw member 41 spaced apart by spacers **53*a*, 53*b*, 53*c* and 53*d* and secured to each other by rivets 55. When viewed in latching position (FIG. 7), the inner end portion 57 is held substantially horizontal by engagement of spacer 53 with the top edge of guide jaw member 41 and is formed with a downwardly open recess 59 of substantially twice the length of the diameter of blade section 37 and substantially the same depth as the diameter of blade section 37, the top edge of recess 59 being straight and horizontal and the corners of the recess being arcuate, the outer edge 62 of recess 59 being of substantially the same radius as blade section 37** and forming a hook.

Figure 6:
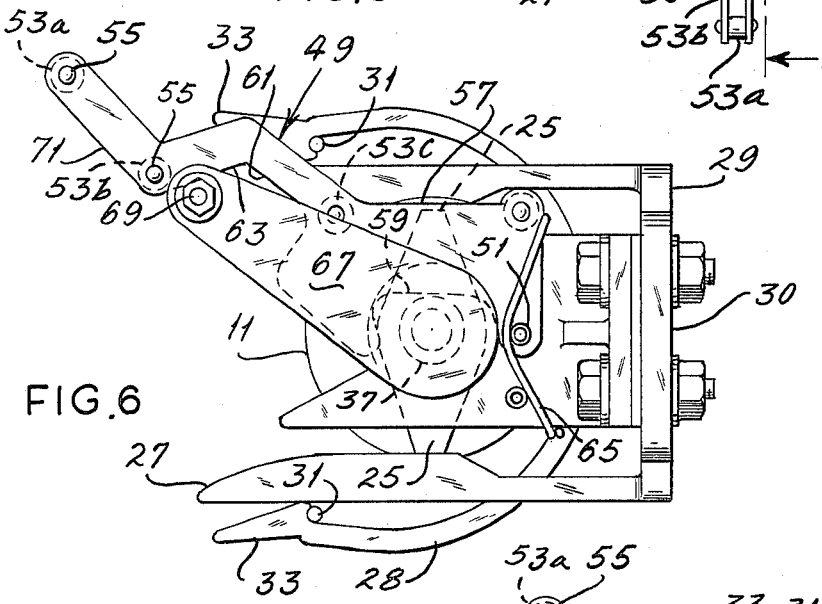
FIG. 6 is an end view of the switch taken from line 6—6 of FIGS. 4 and 5.

Recess 59 is positioned with respect to latch pivot 51 such that when the blade is in fully closed position, it is substantially centered radially of the recess. Radially outwardly of recess 59, the lower edge 60 of the latch member extends outwardly and upwardly at an angle of approximately 30° and the latch member is formed with a second downwardly open recess 61, the outer edge 63 of which slopes upwardly and inwardly at an angle of approximately 60° to the bottom edge. A torsion spring 65 anchored to guide jaw member 41 constantly biases latch member 49 in a counterclockwise direction so that when the blade 11 is in the fully closed position, as seen in FIGS. 6 and 7, latch member 49 will be in the position shown in these views, in which outward movement of blade section 37 is prevented by the interposition of the hook formed by outer edge 62 of recess 59.

For moving latch 49 to blade unlocking position when the blade is rotated to uncam contacts 25 from engagement with contact jaws 27, a radial arm 67 is secured to the end of flange 39 and when the blade is closed and cammed into contact position, arm 67 is so positioned on blade flange 39 that a stud 69 engages the lower end portion of outer edge 63 of recess 61 in latch member 49. As the blade contacts are uncammed, arm 67 rotates clockwise and through continuous engagement with edge 63 of recess 61 causes latch member 49 to move from the closed position of FIG. 7 to the open position of FIG. 8, in which the hook formed by outer edge 62 of recess 59 is completely clear vertically of blade section 37, thus permitting blade section 37 and with it the entire blade to move outwardly to the blade open position shown at **11*b* and 11*c* in FIG. 2. When this occurs, torsion spring 65 rotates latch member 49 counterclockwise until spacer 53 engages the top edge of upper guide jaw 43 and prevents further counterclockwise movement of latch 49 beyond the locked position shown in FIG. 7. In order to open the latch to permit return of the blade to fully closed position, as best seen in FIG. 7, radially outwardly of outer edge 63 of recess 49, the lower edge 71 of the latch extends radially outwardly and upwardly at a slightly greater inclination than the intermediate portion 60 of the latch lower edge and terminates at a level higher than the fully open position of stud 69 on arm 67, as shown at 69*b* in FIG. 7, such that as the blade is swung toward closed position, stud 69 will underride edge 71, radius 73 joining edge 71 to outer edge 63 of recess 61, and edge 63 to move latch 49 clockwise to the position shown in FIG. 8, in which the outer edge of recess 59 is vertically clear of blade section 37 and permits the latter to return to its normal closed position. As the blade contacts 25 are rotated counterclockwise to their contact jaw engaging position corresponding counterclockwise rotation of arm 67 moves stud 69 from the position shown in FIG. 8 to the position shown in FIG. 7, thus permitting spring 65 to rotate latch member 49 counterclockwise to the locking position shown in FIG. 7, whrein any movement of blade 11 away from closed position prior to the uncamming of blade contacts 25 is positively prevented by the interposition of the hook formed by outer edge 62 of slot 59 with respect to blade section 37**.

Operation of the switch unit is as follows: With the switch in closed position, through the operating linkage (not shown), crank 6 is rotated clockwise, causing a corresponding rotation of shaft 4, insulator 5 and base 7. Initial rotation of base 7 causes arm 19 acting through lever 23 to rotate blade 11 approximately 22½° about its longitudinal axis from the position best seen in FIGS. 6 and 7 to the position shown in FIG. 8, wherein contacts 25 on blade 11 are uncammed from engagement with contact jaws 27. This rotational movement of the blade about its axis causes arm 67 on the end of the blade to rotate clockwise through the same angle and through the engagement of stud 69 with inclined surface 63 of latch member 49 raises hook portion 62 of the latch member vertically clear of the reduced section end portion 37 of the blade, such movement of the latch member 49 being resiliently opposed by torsion spring 65. Continued rotation of crank arm 6, shaft 4, insulator 5 and base 7 causes blade 11 to swing through the position shown at 11a in FIG. 2, wherein arcing horns 31 assume the bent position **31*a*, to the open position shown at 11*b* in FIG. 2, in which the arcing horns have snapped completely free of arcing contact hooks 33 and have returned to position 31*b* parallel to the switch blade. During this continued movement of the blade, still in the 22½° rotational position, stud 69 on latch operating arm 67 moves outwardly underriding surface 63 on the latch member 49, permitting the latter to be returned by spring 51 to its normal closed position similar to that shown in FIGS. 6 and 7, but with the blade completely away from the contact jaws in the position shown at 11*b* in FIG. 2**.

Figure 7:
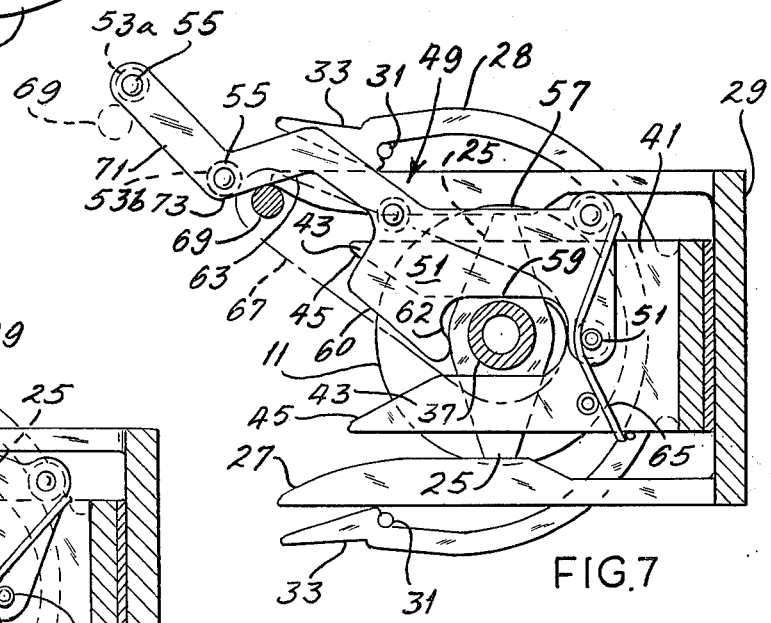
FIG. 7 is a transverse vertical sectional view taken along lines 7—7 of FIGS. 4 and 5 showing the blade locked in closed position.

To close the switch, crank arm 6 is rotated counterclockwise, causing similar rotation of shaft 4, insulator 5 and base 6 until stud 69 engages the radially outer lower edge 71 of the latch member, as best seen at **69*b* in FIG. 7. Continued counterclockwise movement of blade 11 causes stud 69 to underride lower edge 71 and inclined portion 63 to produce clockwise rotation of the latch member 49 until hook portion 62 thereof is vertically clear of reduced section portion 37 of the blade, which can then be swung into its fully closed position in which the blade is rotated until its lug is substantially vertical with contacts 25 cammed into conductive engagement with jaws 27. During the counterclockwise rotation of the blade about its shaft from the open position of FIG. 8 to the closed position of FIGS. 6 and 7, stud 69 on arm 67 is moved downwardly, i.e., counterclockwise from the position of FIG. 8 to the position of FIGS. 6 and 7, thus permitting latch member 49 to be rotated counterclockwise by spring 65 to the position of FIGS. 6 and 7, wherein hook portion 62 of the latch member is interposed radially outwardly of reduced section portion 37 to positively prevent any opening movement of the switch. The final rotation of the blade about its axis seats arcing horns 31 against hooks 33**.

The details of the switch and latch may be varied substantially without departing from the spirit of the invention and the exclusive use of those modifications as come within the scope of the claims is contemplated.

I claim:

1. In a high voltage air break disconnect switch, an elongated blade, a terminal at each end of said blade, means mounting the blade at its one end to swing about one terminal toward and away from the other terminal, a contact on the other end of said blade, said blade being rotatable about its longitudinal axis to shift said contact into and out of engagement with the other terminal when the blade is adjacent the other terminal, and a latch member pivoted to said other terminal on an axis parallel to said blade and having a hook portion positionable in the path of swinging movement of said other end of the blade toward open position to block such movement when said blade is in fully closed position, said blade having a radial arm fixed to its other end abuttingly engageable with said latch member, said radial arm being rotatable when said blade rotates about its axis out of contact with said other terminal for moving said latch member and the hook portion thereof out of the path of said blade to permit said blade to swing away from said other terminal.

2. In a high voltage air break disconnect switch according to claim 1, resilient means normally biasing said latch member toward blade latching position.

3. In a high voltage air break disconnect switch according to claim 2, said latch member having an inwardly and upwardly inclined lower edge member radially outwardly of said hook portion engageable with said blade-mounted arm for raising said latch member out of latching position when said blade is rotated from closed position about its longitudinal axis.

4. In a high voltage air break disconnect switch according to claim 3, said latch member having a lower edge extension radially outwardly of said latch member from said inwardly and upwardly inclined surface portion thereof and positioned for upward and outward inclination when said latch member is in fully closed position and for overlying engagement with said arm as said blade is moved toward closed position, whereby upon rotation of said blade about its longitudinal axis to fully closed position, said arm underrides said extension and said upwardly and inwardly inclined surface portions of said latch member to raise said hook portion thereof vertically clear of said blade to permit the entry of said blade to fully closed position, said arm being rotatable with rotation of said blade about its axis to fully closed position to permit said resilient means to rotate said latch member into latching position wherein said hook portion thereof obstructs movement of said blade away from closed position.

5. In a high voltage air break disconnect switch according to claim 4, said other terminal comprising a pair of vertically spaced contact jaws and said blade contact comprising a vertically elongated cross section portion of said blade adapted for frictional engagement with said contact jaws when in normal vertical closed position and rotatable therefrom about the axis of said blade when said blade is rotated about its axis from closed position.

6. In a high voltage air break disconnect switch according to claim 5, said other terminal having a pair of vertically spaced guide jaws for said blade, said latch member being pivoted to said guide jaws inwardly thereof.

7. In a high voltage air break disconnect switch according to claim 6, said blade having an end portion of reduced cross section receivable between said guide jaws and engageable with said latch member hook portion.

8. In a high voltage air break disconnect switch according to claim 7, said arm being mounted on the end portion of said blade adjacent said reduced section thereof and having a cylindrical element mounted on its outer end, said cylindrical element forming the contact between said arm and the bottom edge portions of said latch member.

9. In a high voltage air break disconnect switch according to claim 8, said guide jaws being formed of a plate extending transversely of said switch blade and said latch member being formed of a pair of plates rigidly secured to each other and disposed on opposite vertical surfaces of said guide jaw plate.

10. In a high voltage air break disconnect switch according to claim 9, said resilient means comprising a torsion spring mounted on said guide jaw plate member and having a portion engageable with said latch, there being stop means on said latch engageable with said guide jaw member for limiting spring-induced downward movement of said latch to fully closed position.

* * * * *